US006350209B1

(12) United States Patent
Chen

(10) Patent No.: US 6,350,209 B1
(45) Date of Patent: Feb. 26, 2002

(54) GOLF CLUB HEAD FORMED OF A HEAD CASE AND A BALL-STRIKING PLATE DOUBLY FUSED WITH THE HEAD CASE

(76) Inventor: Archer C. C. Chen, No. 501, 28th Road, Taichung Industrial Park, Taichung (TW)

( * ) Notice: Subject to any disclaimer, the term of this patent is extended or adjusted under 35 U.S.C. 154(b) by 0 days.

(21) Appl. No.: 09/481,415

(22) Filed: Jan. 12, 2000

(51) Int. Cl.[7] ..... A63B 53/04
(52) U.S. Cl. ..... 473/342; 473/345; 473/349
(58) Field of Search ..... 473/324, 342, 473/345, 346, 349, 350, 348

(56) References Cited

U.S. PATENT DOCUMENTS 5,094,383 A * 3/1992 Anderson
5,261,663 A * 11/1993 Anderson
5,282,624 A * 2/1994 Viste
5,431,396 A * 7/1995 Shieh
5,433,440 A * 7/1995 Lin
5,518,240 A * 5/1996 Igarashi
5,720,673 A * 2/1998 Anderson
5,816,936 A * 10/1998 Aizawa
5,871,408 A 2/1999 Chen

* cited by examiner

*Primary Examiner*—Sebastiano Passaniti
(74) *Attorney, Agent, or Firm*—Browdy and Neimark

(57) ABSTRACT

A golf club head is formed of a head case, and a ball-striking plate which is fused in the head case by a hard soldered layer formed of a molten hard solder in the fusion surface of the ball-striking plate and the head case, and by an annular fusion portion of a molten welding material along the annular fusion line of the ball-striking plate and the head case.

3 Claims, 4 Drawing Sheets

GOLF CLUB HEAD FORMED OF A HEAD CASE AND A BALL-STRIKING PLATE DOUBLY FUSED WITH THE HEAD CASE

FIELD OF THE INVENTION

The present invention relates generally to a golf club head, and more particularly to a golf club head comprising a head case and a ball-striking plate which is doubly fused with the head case.

BACKGROUND OF THE INVENTION

As shown in FIG. 1, a prior art wooden golf club head 80 is formed of a head case 81 and a ball-striking plate 82 which is joined with the head case 81 by welding such that the plate 82 is first joined with the front side of the case 81, and that the annular line between the case 81 and the plate 82 is fused by the welding material to form an annular welded portion 83 fusing the plate 82 with the case 81.

As shown in FIG. 2, another prior art wooden golf club head 85 is formed of a case 86 and a ball-striking plate 87. The case 86 has an arcuate front edge. The plate 87 has a back whose outer peripheral portion and the case 86 form an annular groove 88. The welding is done along the groove 88 to form a welded portion 89 of a relatively greater area and a relatively greater fusion strength.

The U.S. Pat. No. 5,871,408 issued to this inventor of the present invention discloses a wooden golf club head 90 comprising a club head case 91 and a ball-striking plate 92 fused in the recess 93 of the case 91, as shown in FIG. 3. The fusion portion (the wall and the bottom of the recess 93) of the case 91 and the plate 92 is provided with a welded layer 94 which is formed by a molten welding material.

Such prior art golf club heads as described above are defective in design in that the strength of their respective fusion portion is inadequate, and that their fusion portion are apt to crack upon impact of the ball.

SUMMARY OF THE INVENTION

The primary objective of the present invention is to provide a golf club head free from the structural deficiency of the prior art golf club heads described above.

In keeping with the principle of the present invention, the foregoing objective of the present invention is attained by a golf club head comprising a head case of a metal, and a ball-striking plate of a metal. The head case has a recess extending from the front side of the case toward the rear side of the case. The ball-striking plate is joined with the head case such that the peripheral edge of the ball-striking plate is fused with the edge opening of the recess, and that the ball-striking plate is joined with the head case by a soldered layer formed by the molten hard solder, and that an annular fusion portion is formed along the line between the head case and the ball-striking plate.

DETAILED DESCRIPTION OF THE INVENTION

Figure 1:
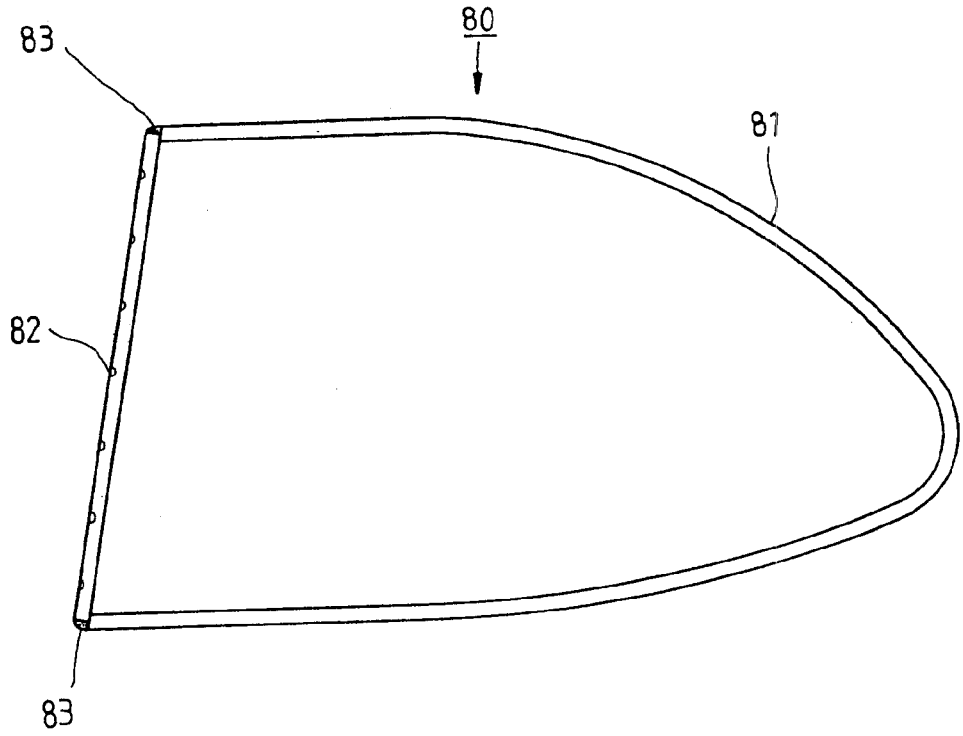
FIG. 1 (PRIOR ART)
FIG. 1 shows a schematic view of a prior art golf club head.
Figure 2:
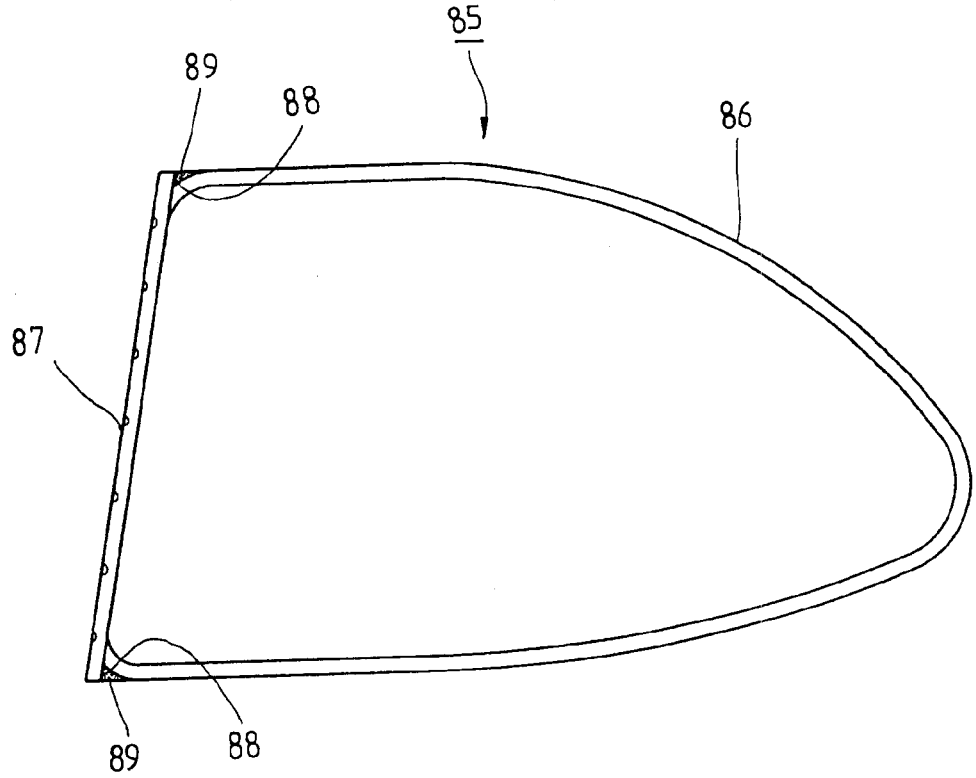
FIG. 2 (PRIOR ART)
FIG. 2 shows a schematic view of another prior art golf club head.
Figure 3:
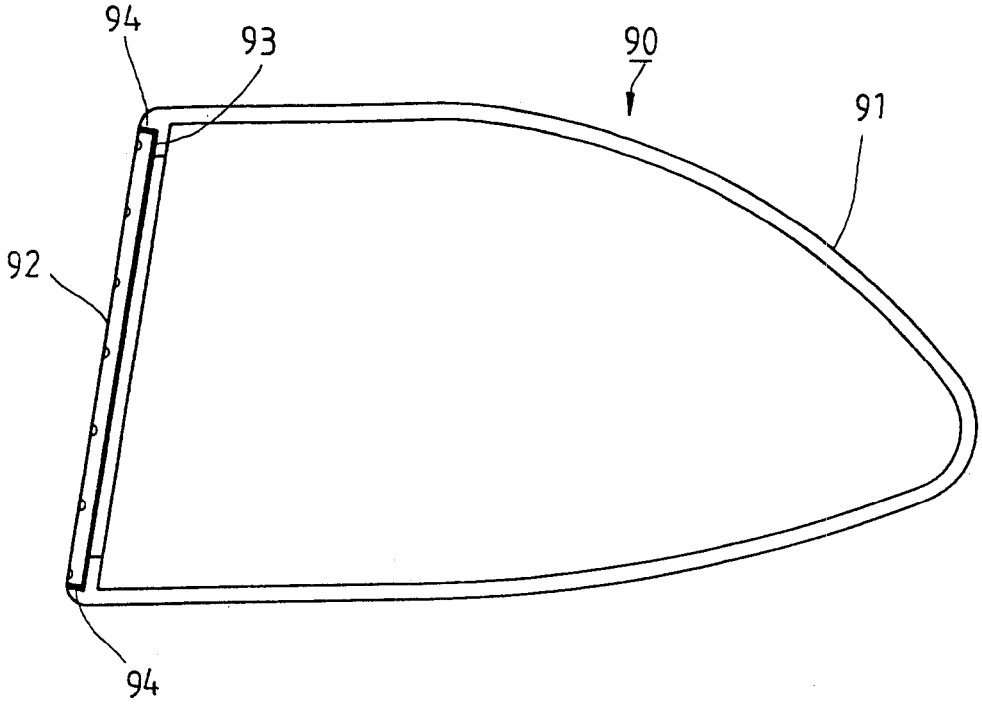
FIG. 3 (PRIOR ART)
FIG. 3 shows a schematic view of a golf club head which is made by a method disclosed in the U. S. Pat. No. 5,871,408.
Figure 4:
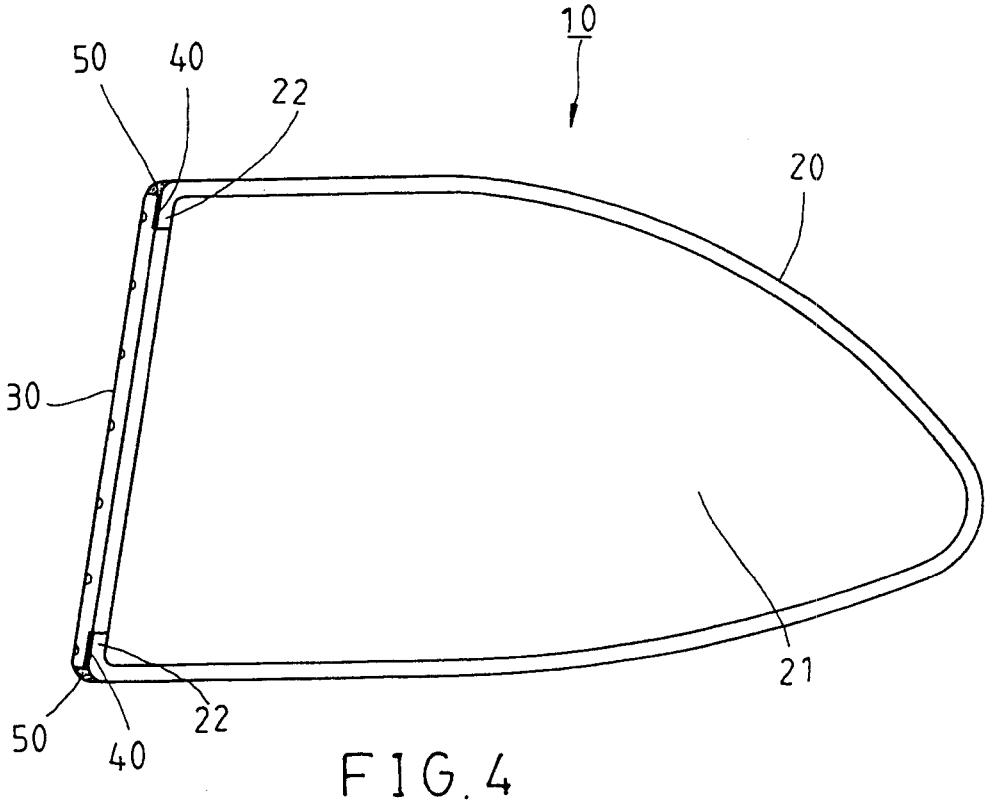
FIG. 4 shows a schematic view of a first preferred embodiment of the present invention.

As shown in FIG. 4, a wooden golf club head 10 embodied in the present invention comprises a head case 20, a ball-striking plate 30, a hard soldered layer 40, and an annular fusion portion 50.

The head case 20 is made of stainless steel and is corresponding in profile to the head 10. The head case 20 is provided with a recess 21 corresponding in location to the ball-striking face of the head 10. The wall of the head case 20 is uniform in thickness. The edge of the recess 21 is curved inward to form a fusion flat portion 22 circumscribing the edge of the recess 21.

The ball-striking plate 30 is made of titanium or maraging steels and is corresponding in shape to the ball-striking face of the head 10. The ball-striking plate 30 is joined with the head case 20 such that the outer fringe of the inner side of the ball-striking plate 30 is fused with the outer side of the flat portion 22 of the head case 20.

The hard soldered layer 40 is formed on the portion fusing the head case 20 and the ball-striking plate 30. The hard soldered layer 40 is formed of a silver-based hard solder.

The annular fusion portion 50 is formed of a solder such that the annular fusion portion 50 extends from the fringe of the ball-striking plate 30 to the fusion line between the fringe of the ball-striking plate 30 and the head case 20.

The ball-striking plate 30 is thus doubly fused with the head case 20 by the hard soldered layer 40 and the annular fusion portion 50.

In the process of making the golf club head 10 of the present invention, the head case 20 and the ball-striking plate 30 are prepared in such a manner that the outer side of the flat portion 22 of the head case 20 is coated with an appropriate amount of a silver-based hard solder ointment. The ball-striking plate 30 is then located in the front side of the head case 20. The head case 20 and the ball-striking plate 30 are then heated at a temperature ranging between 600° C. and 950° C. in a vacuum oven or in a high-temperature oven containing an inert gas. The hard soldered layer 40 is thus formed of the molten hard solder by capillarity. Thereafter, the annular fusion portion 50 is formed by welding an alloy welding material along an annular fusion line between the ball-striking plate 30 and the head case 20. Finally, the golf club head 10 so made is polished and finished.

Figure 5:
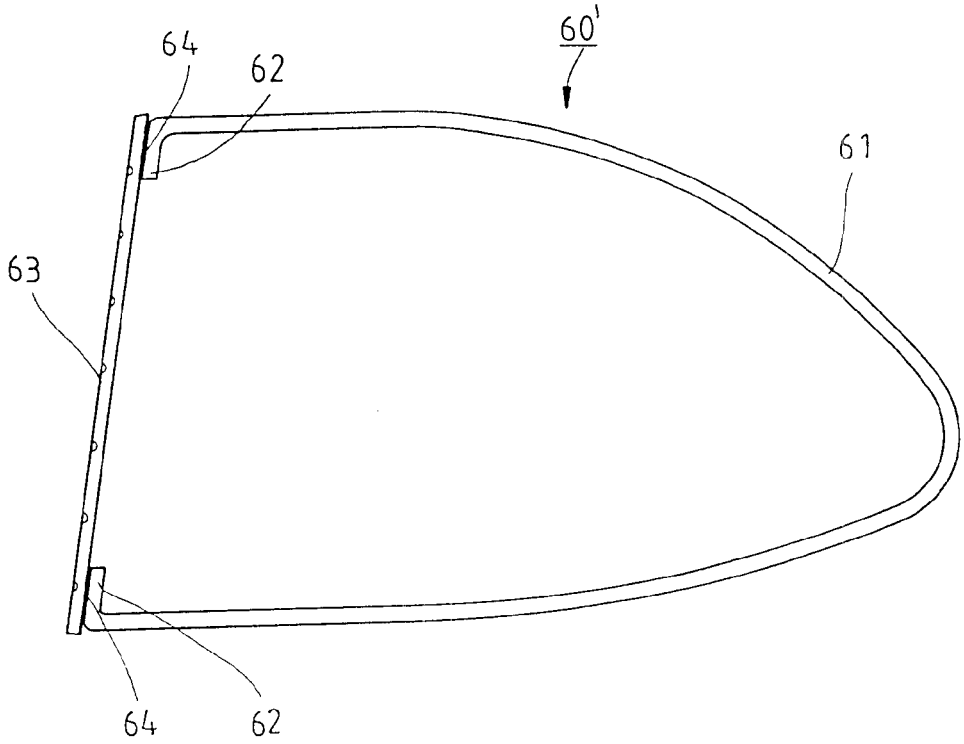
FIG. 5 shows a schematic view of a semifinished product of a second preferred embodiment of the present invention.
Figure 6:
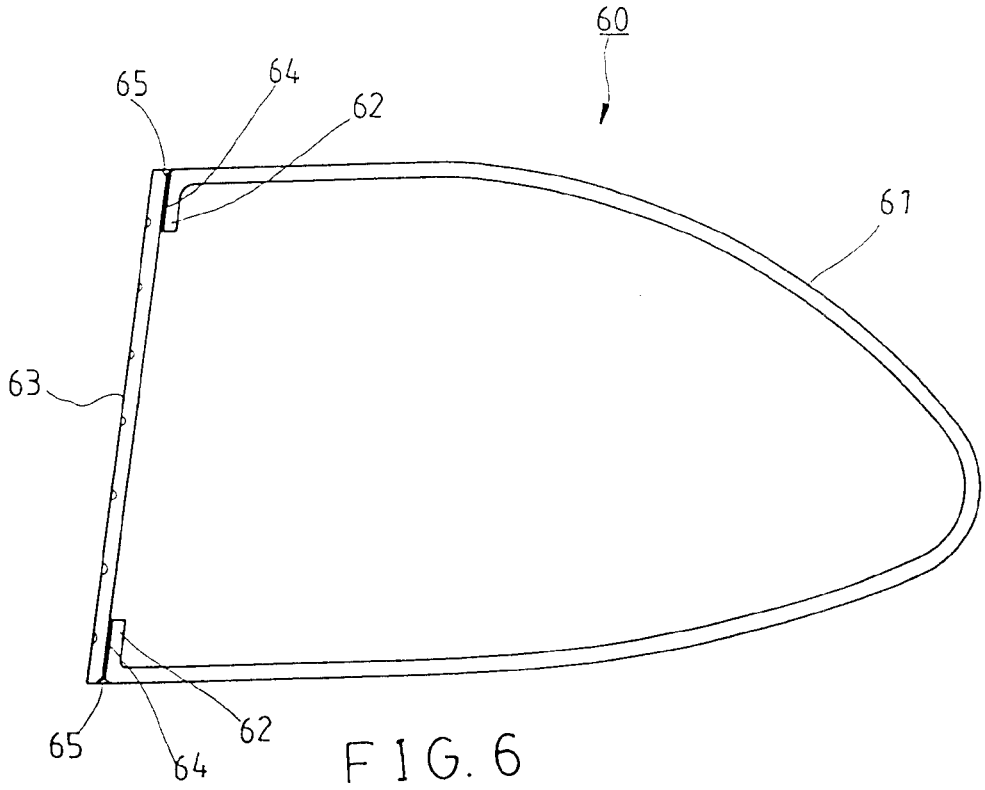
FIG. 6 shows a schematic view of a finished product of the second preferred embodiment of the present invention.

Now referring to FIGS. 5 and 6, a wooden golf club head 60 of the second preferred embodiment of the present invention is shown to be basically similar in construction to the golf club head 10 of the first preferred embodiment described above. The head 60 is formed of a head case 61 and a ball-striking plate 63. The head case 61 is provided in the front side thereof with a flat portion 62. The ball-striking plate 63 is securely joined with the head case 61 by a hard soldered layer 64 and an annular fusion portion 65. In the process of forming the annular fusion portion 65, the ball-striking plate 63 is so made that the fringe of the ball-striking plate 63 is slightly jutted out of the periphery of the head case 61, as shown in FIG. 5. When the head case 61 and the ball-striking plate 63 are heated at a high temperature, the fringe of the ball-striking plate 63 and the curved portion of the flat portion 62 of the head case 61 are melted to form the annular fusion portion 65. In other words, the annular fusion portion 65 of the golf club head 60 of the second preferred embodiment of the present invention is formed without using a welding material.

Figure 7:
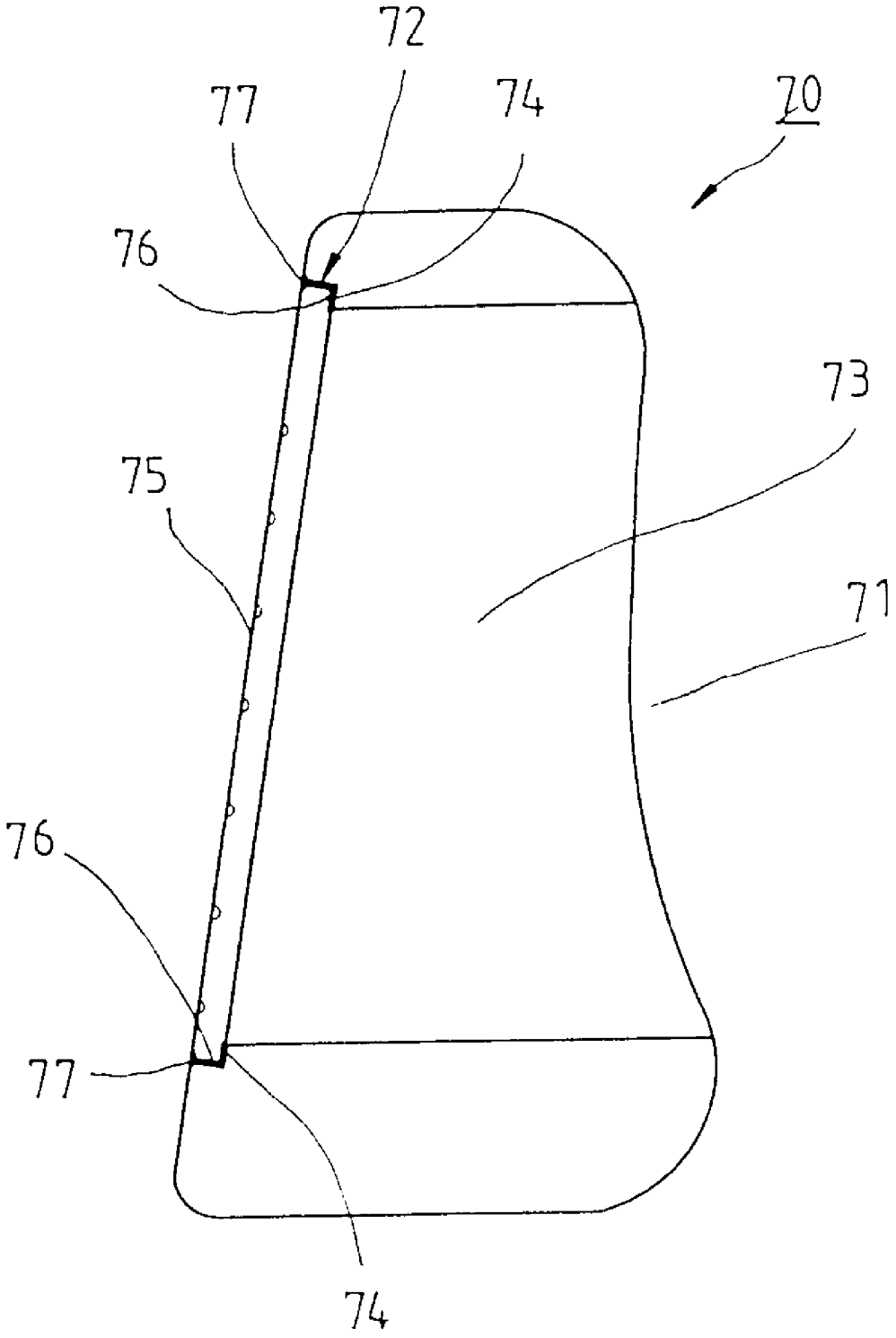
FIG. 7 shows a schematic view of a third preferred embodiment of the present invention.

As shown in FIG. 7, an iron golf club head 70 of the third preferred embodiment of the present invention is formed of a head case 71 of metal, a ball-striking plate 75 of metal, a hard soldered layer 76, and an annular fusion portion 77.

The head case 71 is provided with a slot 72 corresponding in location to the ball-striking face of the head 70. The slot 72 is provided in the bottom thereof with a recess 73 extending rearward from the center of the bottom of the slot 72 such that the recess 73 penetrates the head case, and that an annular shoulder 74 is formed along the fringe of the bottom of the slot 72.

The ball-striking plate 75 is inserted into the slot 72 of the head case 71.

The hard soldered layer 76 is formed of the molten hard solder on the peripheral wall of the slot 72 and on the annular shoulder 74. The outer edge and the fringe of the back of the ball-striking plate 75 is fused with the head case 71 by the hard soldered layer 76.

The annular fusion portion 77 is formed on the fusion line between the head case 71 and the ball-striking plate 75 with or without the welding material.

What is claimed is:

1. A golf club head comprising:

a stainless steel head case having a recess;

a flat projection circumscribing the recess and projecting inward partially over the recess from a terminal edge of the head case;

a titanium or maraging steel ball-striking plate covering the recess and fixed to the flat projection by a silver base hard soldered layer formed between an inner surface of the ball-striking plate, the flat projection being parallel to the ball-striking plate and having an exposed edge abutting the terminal edge of the head case; and an annular fusion portion of a molten metal formed along an annular joint between the exposed edge of the ball-striking plate and the terminal edge of the head case.

2. The golf club head as defined in claim 1, wherein said annular fusion portion is formed of a welding material.

3. The golf club head as defined in claim 1, wherein said annular fusion portion is formed by fusing the exposed edge of said ball-striking plate and the terminal edge of said head case together along the joint.

* * * * *